US011633034B2

(12) United States Patent
Brilland et al.

(10) Patent No.: US 11,633,034 B2
(45) Date of Patent: Apr. 25, 2023

(54) COSMETIC RECEPTACLE SYSTEM FOR PRODUCING COSMETIC RECEPTACLES WHILE USING IDENTICAL PARTS

(71) Applicant: GEKA GmbH, Bechhofen (DE)

(72) Inventors: Arnaud Brilland, Bechhofen (DE); Sacha Cusseau, Bechhofen (DE); Friedrich Weigel, Bechhofen (DE)

(73) Assignee: GEKA GmbH, Bechhofen (DE)

( * ) Notice: Subject to any disclaimer, the term of this patent is extended or adjusted under 35 U.S.C. 154(b) by 256 days.

(21) Appl. No.: 16/956,042

(22) PCT Filed: Dec. 19, 2018

(86) PCT No.: PCT/EP2018/085919
§ 371 (c)(1),
(2) Date: Jun. 19, 2020

(87) PCT Pub. No.: WO2019/121967
PCT Pub. Date: Jun. 27, 2019

(65) Prior Publication Data

US 2021/0106117 A1 Apr. 15, 2021

(30) Foreign Application Priority Data

Dec. 19, 2017 (DE) ..... 202017107731.4
Sep. 28, 2018 (DE) ..... 202018105591.7

(51) Int. Cl.
*A45D 40/18* (2006.01)
*A45D 34/04* (2006.01)
(Continued)

(52) U.S. Cl.
CPC ..... *A45D 40/18* (2013.01); *A45D 34/045* (2013.01); *A45D 40/265* (2013.01); *B65D 88/28* (2013.01);
(Continued)

(58) Field of Classification Search
CPC .... A45D 40/18; A45D 34/045; A45D 40/265; A45D 2034/007; A45D 2040/0012; A45D 2034/005; A45D 2200/25; B65D 88/28
See application file for complete search history.

(56) References Cited

U.S. PATENT DOCUMENTS 6,371,334 B1 4/2002 Lombardi
7,661,563 B2 * 2/2010 De Lataulade ..... B65D 83/32 222/244
(Continued)

FOREIGN PATENT DOCUMENTS

JP H07315414 A * 7/1995 ..... B65D 51/18
JP 3496045 B2 2/2004

*Primary Examiner* — Vishal Pancholi

(57) ABSTRACT

A cosmetic receptacle system consisting of a receptacle (2), which is self-supporting or consists of flexible film over a majority of its volume and one end of which constitutes a withdrawal opening in the form of a tapered neck (4), and a cap (4*a*), whereas the system also has several concealing sleeves (5) with different outer cross-sectional shapes and several adapter rings (8), each adapter ring (8) having a socket for the neck (4) of the receptacle (2), enclosing the latter in the circumference direction, and constituting at least one stop, which prevents the receptacle (2) from being pulled outward through the adapter ring (8), and each adapter ring (8), at its end oriented toward the bottom (7) of the receptacle (2), having an adapter section (11) whose outer cross-section essentially corresponds to the outer cross-section that a concealing sleeve (5) that corresponds to this adapter ring (8) has at its free end oriented toward the neck (4) of the receptacle (2).

14 Claims, 12 Drawing Sheets

(51) Int. Cl.

| | |
|---|---|
| ***A45D 40/26*** | (2006.01) |
| ***B65D 88/28*** | (2006.01) |
| *A45D 34/00* | (2006.01) |
| *A45D 40/00* | (2006.01) |

(52) U.S. Cl.
CPC ..... *A45D 2034/007* (2013.01); *A45D 2040/0012* (2013.01)

(56) References Cited

U.S. PATENT DOCUMENTS

| | | | | |
|---|---|---|---|---|
| 8,074,839 | B2 * | 12/2011 | Ronsin | B05B 11/0038 215/12.2 |
| 8,807,857 | B2 * | 8/2014 | L'Abbate | A45D 34/045 132/218 |
| 2012/0279876 | A1 * | 11/2012 | Weigel | A45D 40/265 401/126 |
| 2019/0350342 | A1 * | 11/2019 | Mathiez | B65D 51/32 |

* cited by examiner

COSMETIC RECEPTACLE SYSTEM FOR PRODUCING COSMETIC RECEPTACLES WHILE USING IDENTICAL PARTS

The invention relates to a cosmetic receptacle system according to the preamble to claim 1.

TECHNICAL BACKGROUND

In practice, there has long been a need for a very large number of very different cosmetic receptacles, not least in the mascara, eyeliner, and lip care sector. This is because especially in the more attractive high-priced market segment, not only are good cosmetics sold, but also the products, by virtue of their design, are also accompanied by emotions and prestige, which is why there is demand for such a wide variety of designs.

At the same time, cosmetic receptacles must remain hermetically sealed over long periods in the closed state and usually also in the re-closed state after being opened for the first time in order to reliably prevent their contents from drying out or otherwise aging and in order to reliably prevent their contents from becoming contaminated.

The vast majority of cosmetic receptacles of this kind are therefore produced as a plastic part that is of one piece and is thus correspondingly leakproof. As a rule, the production is carried out by means of so-called blow molding or injection molding. In both cases, a mold is required, which gives the cosmetic receptacle its precisely defined shape at least on the outside and its flawless outer surface. Molds of this kind are expensive and are therefore only suitable for large quantities, allowing the costs to be amortized over time in the course of their production.

Because of this, the known techniques do not permit the achievement, for example, of so-called "limited Editions." These include, for example, small batches, e.g. of a known eye care or lip care product, furnished for a particular topical event. The small batch in question is eye-catching due to its cosmetic receptacle having been temporarily provided with an exceptional design, thus enticing consumers to buy.

The Object Underlying the Invention

In light of the foregoing, the stated object of the invention is to provide cosmetic receptacles, which can be provided with different design at a lower cost than before.

The Attainment of the Object According to the Invention

The object is attained according to the invention with the features of claim 1.

Correspondingly, a cosmetic receptacle system is proposed, which has a series of different components that can be combined to produce cosmetic receptacles with different external designs. The cosmetic receptacle system according to the invention includes at least one self-supporting receptacle, which forms a withdrawal opening at one end in the form of a narrowed neck, and a cap. The term "self-supporting" here, by contrast with a crushable film-blown article, refers to a receptacle that inherently has a definite geometrical form, which it permanently retains even under the influence of gravity when it is resting on its base, entirely without external support. Ideally, the receptacle is a plastic receptacle that has been blow molded or injection molded in an intrinsically known way, usually in the form of a bottle, preferably with the wall thickness described in the first exemplary embodiment.

In addition, the cosmetic receptacle system according to the invention includes several concealing sleeves with different outer cross-sectional shapes. A "concealing sleeve" is understood here to be a sleeve-shaped body, which in the fully assembled state, contains the receptacle and in general, constitutes at least most of the visible outer circumference surface of the ready-to-use and ready-to-sell cosmetic receptacle unit permanently throughout the life of the product. In the simplest case, the sleeve-shaped body is a bottomless tube. Preferably it is a tube that has a closed bottom at one end.

Finally, the cosmetic receptacle system according to the invention includes several different adapter rings.

Each of these adapter rings has a socket for the neck of the receptacle, enclosing the latter in the circumference direction. In the broadest sense, each of the adapter rings constitutes at least one stop, which prevents the receptacle from being pulled outward through the adapter ring.

On its side oriented toward the bottom of the receptacle, each of these adapter rings has an adapter section whose outer cross-section essentially corresponds to the outer cross-section that a concealing sleeve—which corresponds to this adapter, i.e. is intended for assembly with this adapter—has at its free end that is oriented toward the neck of the receptacle in the installed position.

The decisive factor is that without having to perform any adapting work steps, the at least one receptacle can be assembled with several different concealing sleeves and the adapter rings associated with them in order to form different respective cosmetic receptacle units, i.e. ones with different external designs.

Since only one receptacle is used or—in large systems—compared to the number of different designs, only a number of receptacles that is smaller than the total number of different designs that can be produced is used, it is not necessary to manufacture an expensive mold for each newly designed cosmetic receptacle.

The cosmetic receptacle system according to the invention is also highly suitable, for example, for the use of concealing sleeves that are produced from plastic by means of 3D printing. In this regard, it is advantageous that because of the conventionally produced receptacle, it is not necessary to make sure that the concealing sleeve is printed so that it is hermetically sealed. In addition, this also eliminates the need for printing the thread of the receptacle neck, which may be delicate and therefore not well-suited to the 3D printing process.

PREFERRED POSSIBLE EMBODIMENTS OF THE INVENTION

The invention proves to be particularly advantageous if the concealing sleeves are composed of metal.

Then even extremely small batches can be efficiently produced, e.g. by spinning the concealing sleeves on a spinning lathe or by extruding the concealing sleeves. Both of these can be accomplished efficiently, particularly in small quantities. An embodiment of the system components, which ensures that the bottom of the receptacle and the bottom of the concealing sleeve are uniformly spaced apart from each other, preferably by at least 4 mm, is preferred. This also includes greater deviations of the kind that can occur in the blow molding of a plastic receptacle.

Preferably, at least one of the concealing sleeves belonging to the system does not have a closed bottom, but rather a passage whose inner opening is adapted to the receptacle and which is closed by the receptacle or preferably, by the bottom thereof. Bottomless concealing sleeves offer a high degree of freedom for the creativity of the design embodiment, particularly if the concealing sleeves consist of metal and are produced by means of spinning or another cold forming process. In this case, a bottom would specifically have a negative impact on the deformability.

Ideally, the receptacle or more precisely, its bottom, is wedged into the passage and a seal is produced as a result so that for example no moisture can penetrate and possibly drip out again later.

It is particularly advantageous if the adapter section of an adapter ring is stepped at its edge, which rims the free end of the adapter section that is oriented toward the neck of the receptacle. It therefore forms an annular projection that is preferably closed in the circumference direction. In the assembled state, this projection engages internally behind the wall of the corresponding concealing sleeve. As a result, the correspondingly embodied outer circumference surface of the adapter ring and the correspondingly embodied outer circumference surface of the concealing sleeve are centered relative to each other so that they smoothly transition into each other, entirely or at least substantially.

Ideally, in the place where it engages behind the concealing sleeve, the annular projection is supported from the inside by a supporting section of the neck of the receptacle. This preferably occurs in such a way that the annular projection is clamped in a frictional, nonpositive way between the inner surface of the concealing sleeve and the supporting section of the neck.

In another preferred exemplary embodiment, the concealing sleeve is embodied so that it embraces the neck of the receptacle to such a degree that when the receptacle is inserted all the way into the concealing sleeve between the concealing sleeve and the neck of the receptacle, an annular open space is produced between these components, which accommodates the entire adapter ring. This is a particularly attractive solution from a visual standpoint because the concealing sleeve thus also offers the critical eye the image of a one-piece receptacle; no seam appears on the outer circumference surface between the adapter ring and the concealing sleeve—which would be highly intrusive in terms of design requirements.

It is particularly advantageous if the adapter sleeves of the system can be detent-locked in a form-fitting fashion to the neck of the receptacle or receptacles belonging to the system.

Ideally, the neck of the receptacle and the passage of the respective adapter ring are matched to each other so that the neck of the receptacle protrudes outward through the passage of the adapter ring. It forms a free neck section there, which is as a rule tubular. In this neck section, a cap can be removed and affixed in a reclosable fashion. Preferably, the cap of the neck section can be detent locked or screwed onto the latter so that it fully embraces its outer circumference. The big advantage of such a design is that the complexly shaped neck section, with its different functional surfaces (e.g. thread, opening aid in the form of bevels, and projections that force a particular closing position of the cap, etc.) is always the same and can be efficiently reproduced by the mold for the receptacle—without having to encumber the adapter ring or the concealing sleeve with this.

Ideally, relative to the section of the neck, which is embraced in a preferably centering fashion by the passage, the freely extending neck section is tapered in such a way that the freely extending neck section—despite the detent bead, the arrangement of detent protrusions, or the thread flank that protrudes outward from it—can be slid through the passage from the inside toward the outside.

It is particularly advantageous if the neck has a sealing section, which protrudes in the radial direction relative to the region in which it surrounds the neck and which in the fully assembled state, is encompassed circumferentially by the passage of the adapter ring. In this case, the outer diameter of the sealing section is greater, preferably 1/10 mm to 3/10 mm greater, than the inner dimeter of the passage. This ensures that in the assembled state, the sealing section is wedged into the passage in an elastically sealing fashion.

In an alternative possible embodiment, the adapter ring fully embraces the entire neck of the receptacle, preferably so that the end of the neck and the adapter ring both end in the same horizontal plane at the height of the withdrawal opening.

In the latter embodiment, in the region in which it embraces the neck section, the adapter ring preferably has a threaded section or at least one detent engagement section for affixing a cover in the form of a cap.

Independent protection is claimed for a cosmetic receptacle unit consisting of a receptacle, a concealing sleeve, and an adapter ring, which are embodied in the way disclosed here for the above-mentioned individual parts.

Other effects, embodiment possibilities, and advantages of the invention ensue from the following description of exemplary embodiments based on the figures.

LIST OF FIGURES

FIG. 1 shows a central longitudinal section through the cosmetic receptacle unit according to FIG. 4 after the cap has been completely removed and the applicator, which is possibly fastened to the cap by means of a wand, has been withdrawn.

FIG. 2 shows a central longitudinal section through the cosmetic receptacle unit according to FIG. 4, in a sectional position that is rotated by 90° around the central longitudinal axis relative to FIG. 2.

FIG. 3 shows an enlargement of the upper region of FIG. 2.

FIG. 4 shows a side view of a first exemplary embodiment of a cosmetic receptacle unit, which is composed of components of the cosmetic receptacle system according to the invention, with a detached and raised cap.

FIG. 4 *a* shows a perspective view of a detail from FIG. 4.

FIG. 5 shows a view of the subject of FIG. 4 after the cap has been completely removed.

FIG. 6 shows a side view of a second exemplary embodiment of a cosmetic receptacle unit, which is composed of components of the cosmetic receptacle system according to the invention, with the cap completely removed.

FIG. 7 shows a central longitudinal section through the cosmetic receptacle unit according to FIG. 6.

FIG. 8 shows an enlargement of the upper region of FIG. 7.

FIG. 9 shows an enlarged, only partially depicted central longitudinal section through a third exemplary embodiment of a cosmetic receptacle unit, which is composed of components of the cosmetic receptacle system according to the invention, with the cap completely removed.

FIGS. 10 through 15 each show a cross-section through a cosmetic receptacle unit, which is composed of components of the cosmetic receptacle system according to the invention, with the section extending through the respective adapter sleeve at the halfway point of the height, perpendicular to the longitudinal axis L.

FIG. 16 shows one variant with a concealing sleeve 5 that is embodied and fastened in a particular way.

FIG. 16 *a* shows an enlarged detail from FIG. 16.

FIG. 16 *b* shows another variant in which the connecting technique of welding or friction welding that is described in connection with FIGS. 16 and 16 *a* has been used and which is therefore physically embodied in a corresponding fashion.

FIG. 17 shows a fifth exemplary embodiment of the invention in a side view.

FIG. 18 shows a fifth exemplary embodiment of the invention in a central longitudinal section.

FIG. 19 shows an enlarged detail from FIG. 18.

As an example, but one that is applicable to all of the exemplary embodiments except for the sixth, FIG. 20 shows a central longitudinal section through a centering of the receptacle by means of a centering ring.

As an example, but one that is applicable to all of the exemplary embodiments except for the sixth, FIG. 21 shows a central longitudinal section through a centering of the receptacle by means of wedging.

As an example, but one that is applicable to all of the exemplary embodiments except for the sixth, FIG. 22 shows a receptacle with gluing tabs embodied in the casing for gluing the receptacle to the inside of the concealing sleeve.

FIG. 23 shows a sixth exemplary embodiment, which differs from all of the others in that a sack-like structure is used to form the receptacle.

As an example, but one that is applicable to all of the exemplary embodiments FIG. 24 discloses an exploded view of a receptacle similar to that one of FIG. 22 and of the adapter ring 8 belonging thereto.

DESCRIPTION OF THE FIGURES

First Exemplary Embodiment

The receptacle 2 is clearly shown. It typically consists of a plastic that is suitable for blow molding. Its wall thickness everywhere or at least in most places, is between 0.85 mm and 1.75 mm. The receptacle is thus self-supporting, as previously described.

The receptacle 2 is preferably composed of a storage section 3. This is adjoined integrally/in one piece by a neck 4.

Figure 16A:
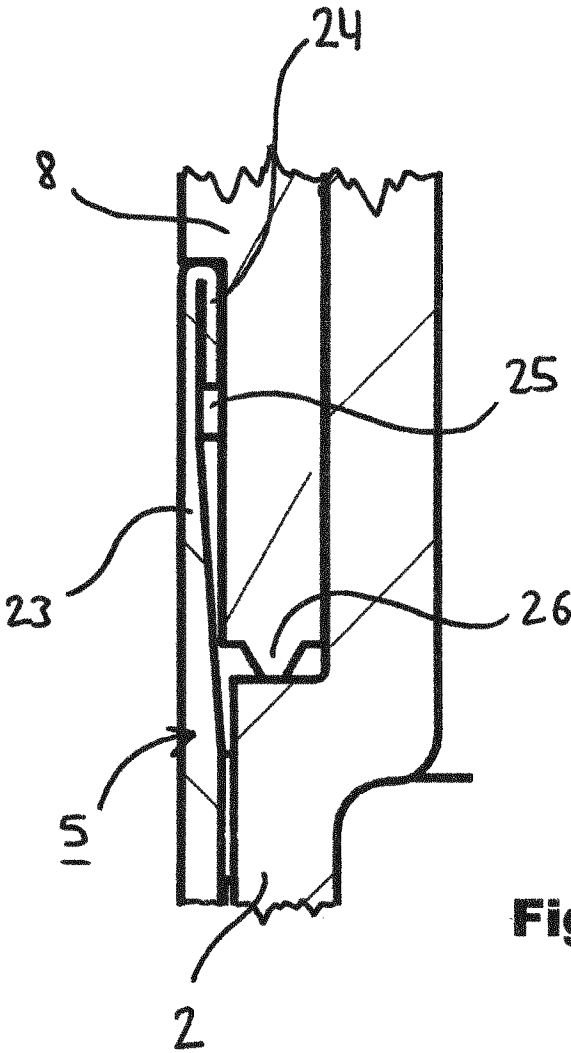
Figure 16:
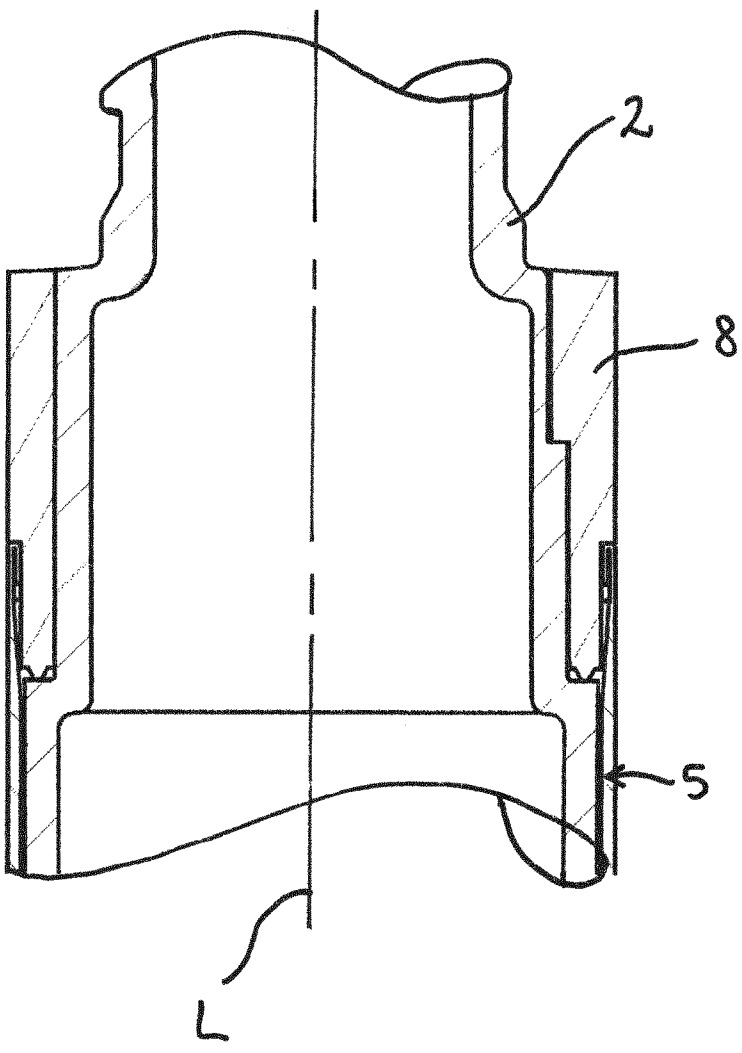

In the fully assembled state, the receptacle is at least largely accommodated inside a concealing sleeve 5. The concealing sleeve ideally consists of metal and can then—optionally—be fastened as illustrated in FIGS. 16 and 16*a*, which will be explained in greater detail further below. Its wall thickness is largely or essentially entirely thinner than the thickness of the receptacle 2. Ideally, its wall thickness is in the range between 0.4 and 0.8 mm. In a particularly preferable embodiment, it also has a bottom 6. In many cases, it is advantageous if a space is provided between the bottom 6 of the concealing sleeve 5 and the bottom 7 of the receptacle 2.

Figure 2:
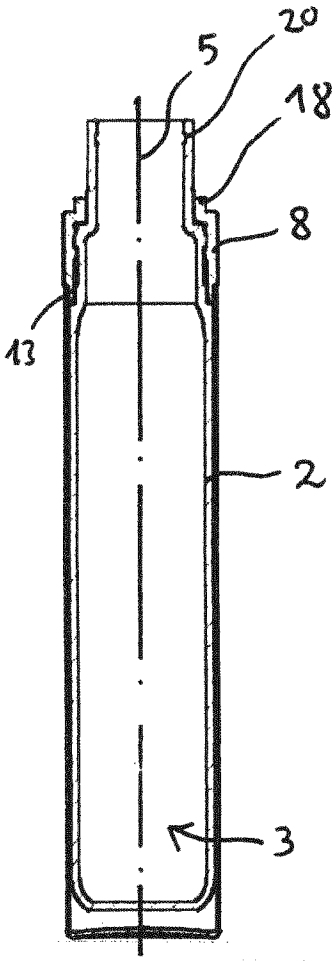
FIGS. 1 and 2 show a cosmetic receptacle unit 1 that has been constructed of components of the claimed cosmetic receptacle system.
Figure 1:
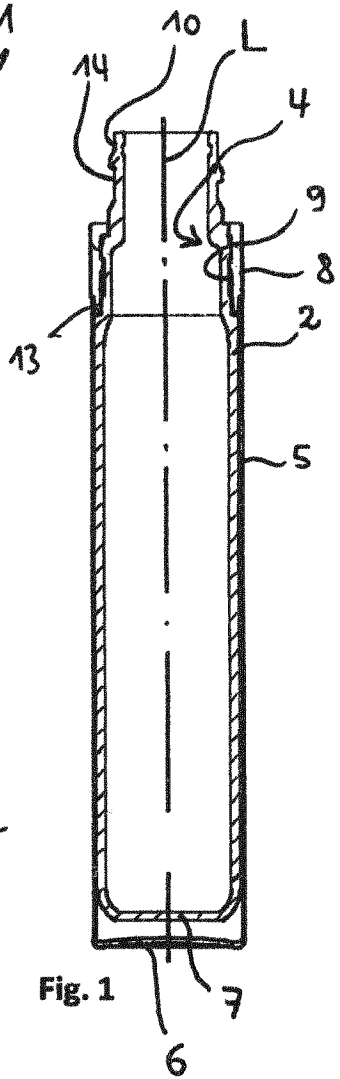

Preferably, the two bottoms 6, 7 are uniformly spaced apart from each other by at least 3 mm or better still, by at least 4 mm, as is clearly shown in FIGS. 1 and 2.

The concealing sleeve 5 in this case is selected to be short enough in the direction of its longitudinal axis L that it essentially does not overlap the neck 4 or in any case, overlaps it by at most 10% of its circumferential surface.

It is readily apparent that an adapter ring 8 is placed over the mouth of the concealing sleeve 5, which is oriented toward the neck 4 of the receptacle 2 and via which the receptacle 2 is inserted into the concealing sleeve 5. The adapter ring 8 has a passage 9 for the neck 4 so that a part of the neck 4 protrudes freely outward through the adapter ring 8 and forms a neck section 10 there, onto which a cover, which is only shown in FIG. 4 here, can be placed, preferably in the form of a cap with a wand 4*c*, to which an applicator that is not shown here is attached, e.g. in the form of a applicator brush with a core from which fingers and/or bristles protrude. This cap accommodates the neck section, largely or preferably entirely, and at least substantially. At the opposite end of its passage 9, i.e. on its side oriented toward the bottom of the receptacle 2 in the properly assembled state, the adapter ring 8 forms an adapter section 11.

The adapter ring can be visible and my form a design element then. In many other cases the adapter element is designed that way that it is as such not visible.

This adapter section 11 has a special function. The outer cross-section or the embodiment on the outer circumference of the adapter section 11 essentially corresponds to the outer cross-section or the embodiment on the outer circumference that has a concealing sleeve 5 that corresponds to this adapter ring 8 at its free end oriented toward the neck of the receptacle 2. This ideally achieves the fact that the adapter ring 8 and the concealing sleeve 5 transition smoothly into each other, i.e. without forming a step or other locally raised region on the circumference. The only thing that indicates the existence of multiple parts is the interstice that is produced at the point on the outer circumference surface where the ends of the adapter section 11 and concealing sleeve 5 abut each other, see FIG. 5.

Figure 5:
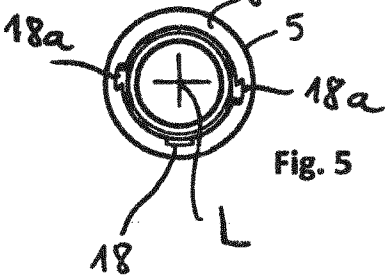

It is particularly advantageous, as shown in FIG. 5, if the adapter ring 8 visually makes up about 10% to 30% of the surface that presents itself visually to the observer as the circumference surface of the cosmetic receptacle unit.

Figure 3:
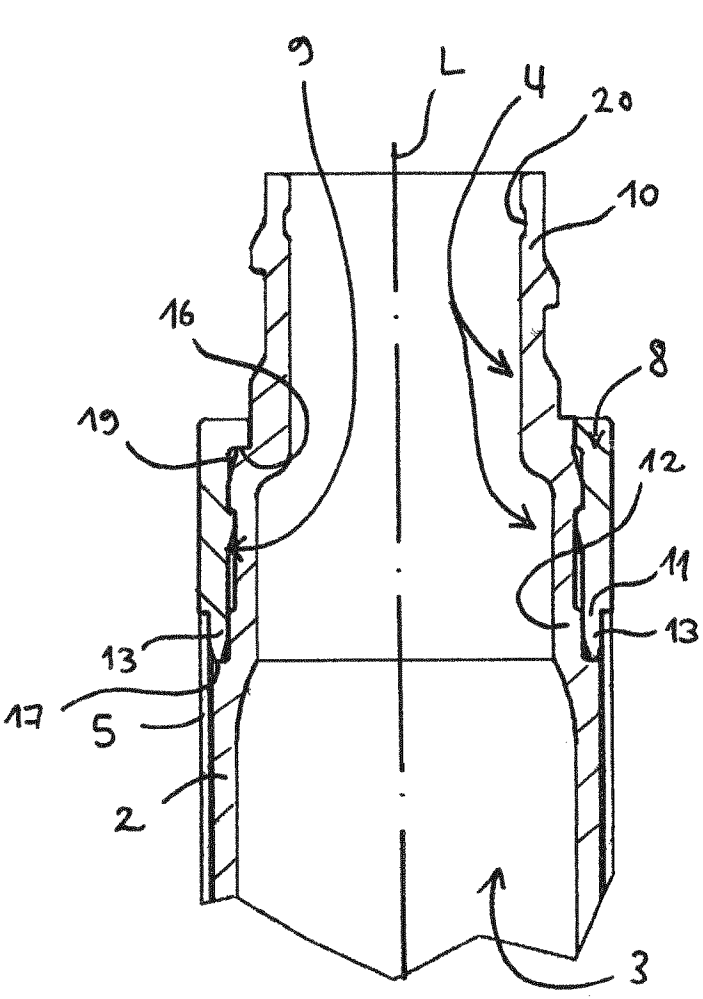

As is shown the most clearly in FIG. 3, a particular design is preferably selected in order to ensure this.

It is clear from FIG. 3 that the adapter section 11 of the adapter ring 8 is stepped at its edge, which rims the free end of the adapter section 11 that is oriented toward the neck of the receptacle. The step is formed in that the outer diameter of the adapter section 11 decreases somewhat circumferentially at the free end. The adapter section 11 thus forms an annular projection 13, which engages from the inside behind the wall of the corresponding concealing sleeve 5. The annular projection 13 can therefore be referred to as a centering ring. Thus according to the preferred principle shown in the figures, the adapter section 11 and the concealing sleeve 5 engage in each other in "tongue and groove" fashion.

The adapter section 11 and the concealing sleeve are centered relative to each other—particularly due to the arrangement described just now.

The centering can be assisted in a particularly effective way by virtue of the fact that in the place where it forms the above-mentioned annular projection 13, which engages behind the concealing sleeve 5, the adapter section 11 is supported from the inside by a supporting section 12 of the neck 4. In this way, this annular projection 13 of the adapter section 11 is caught or even clamped between the inner circumference surface of the concealing sleeve 5 and the outer circumference surface of the supporting section 12.

It is particularly advantageous if in this region in which this annular projection 13 of the adapter section 11 is caught, a permanent anchoring of the concealing sleeve 5 to the adapter ring 8 is provided. This can occur in that the concealing sleeve 5 is pressed-fitted onto this annular projection 13 of the adapter section 11. This is because the annular projection 13 is able to exert the required pressure particularly if it is supported from the inside by the supporting section 12 of the neck 4. To accomplish this, at its free end oriented toward the bottom 7 of the receptacle, the annular projection can be embodied as tapering in a wedge-shaped fashion and can thus form a wedging chock, as can be seen, for example, on close inspection of FIG. 3. The annular projection 13 shown here is beveled on both its inner and outer circumference.

Alternatively or in addition, a glued connection can also be provided here. If a glued connection is provided the overlap in the region in which this annular projection 13 of the adapter section 11 is caught will be enlarged to preferably at least 25 $mm^2$ better at least 35 $mm^2$ to have enough area for a firm glue connection. Alternatively or in addition, it is also possible for a detent engagement to be provided. If the concealing sleeve 5 is made of plastic, then for this purpose, in the region that embraces the annular projection 13 of the adapter section 11, it can have an inward-protruding detent bead, which is inserted into a corresponding detent groove of the annular projection, which is not graphically depicted here.

If the concealing sleeve is composed of metal, then it can be locally pressed inward in annular fashion and then in this way, can form a detent groove. On the outside, then, the region that has been pressed inward for the purpose of forming a detent bead gives the appearance of an annular decorative recess.

It is readily apparent that the adapter ring 8—preferably in the region between its passage 9 and said ring—is in turn fastened to the neck 4. Preferably, the adapter ring 8 is affixed to the neck 4 in a form-fitting way. To accomplish this, the neck 4 can have a detent groove 14 that is engaged by detent elements 15 that protrude inward from the inner circumference surface of the adapter ring 8 or by an inward-protruding detent bead.

As is most readily apparent from FIG. 3, the neck 4 ideally has two steps. Starting from the storage section 3 of the receptacle 2, the neck initially has a first setback in that it has a smaller outer diameter than the storage section. Adjoining this, the neck forms a second setback, the smaller part of which is situated inside the passage 9 and the larger part of which constitutes the neck section 10, which protrudes freely outward. This double setback results in the fact that the neck 4 forms two end ring sections 16 and 17. One end ring section 17 serves as a stop with which the adapter ring 8 prevents the receptacle 2 from being pulled out in the direction of the longitudinal axis.

Figure 4:
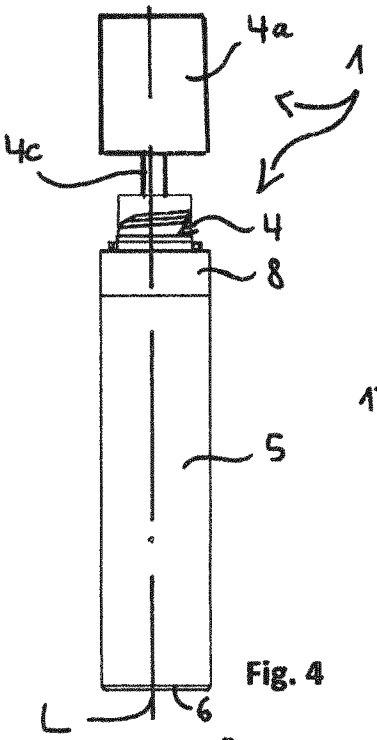
Figure 4A:
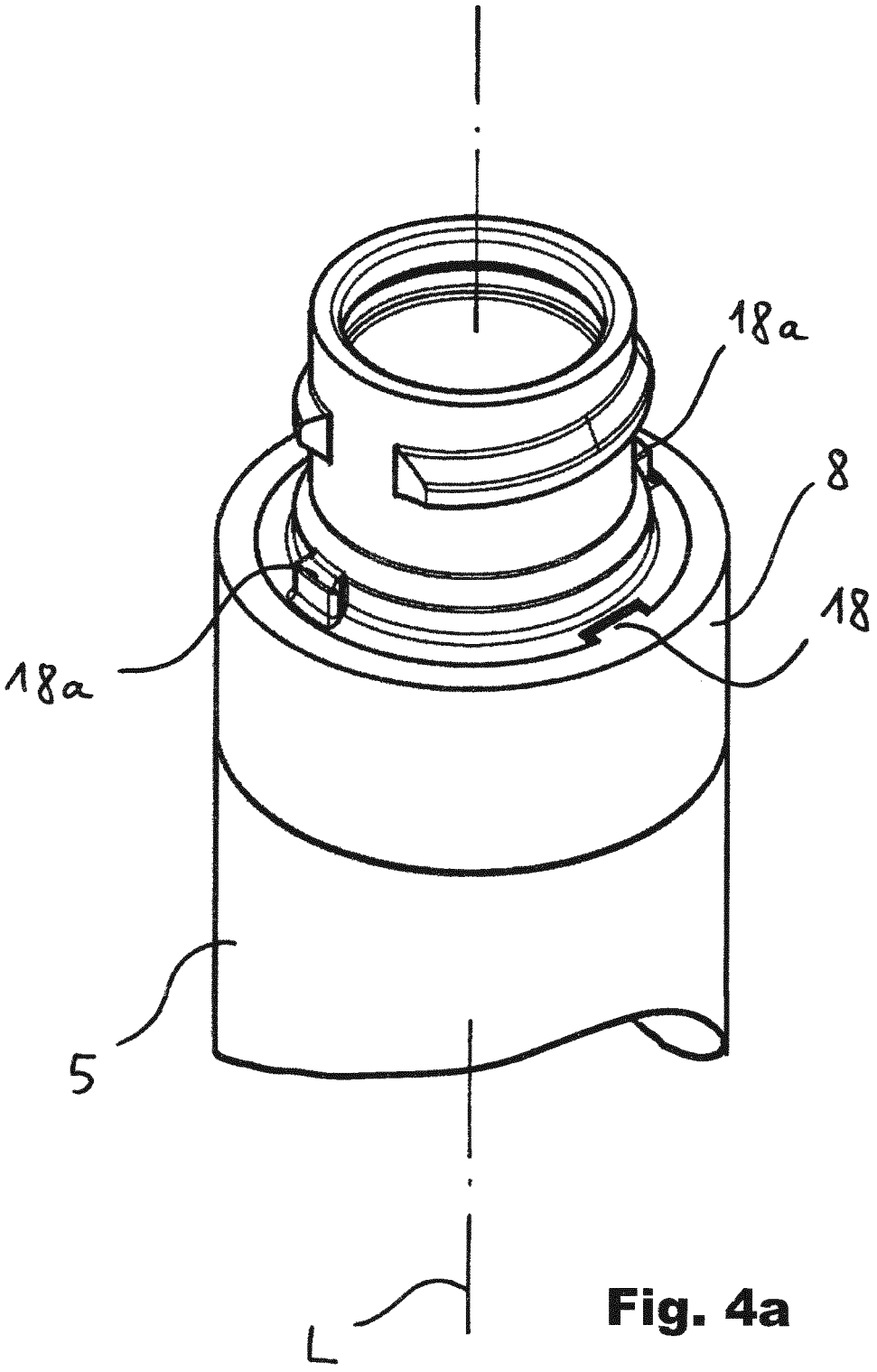

As is most readily apparent from the comparison of FIGS. 2 and 3 with FIG. 1 and based on FIGS. 4 and 4*a*, the adapter ring 8 can advantageously have at least one rotation limiter 18. The rotation limiter 18 ensures that the receptacle 2 can only be installed in a particular position relative to the adapter ring 8 and also permanently retains this position during use.

The rotation limiter 18 make sense primarily in a screw cap that does not itself have a circular cross-section and that is supported on a receptacle 2 that is enclosed by a non-round concealing sleeve. The rotation limiter 18 then contributes to the fact that for example the neck of the receptacle 2 comes to rest in such a way that the rotation stop or stops 18*a* embodied on it are precisely positioned so that the screw cap comes to a stop against this when it is positioned correctly.

It is also readily apparent that the neck 4 has an assembly bevel 19, which centers the adapter ring 8 and facilitates the process of sliding it on, before the adapter ring reaches its detent-locked position on the neck 4. It is also readily apparent from FIG. 3 that in the present instance, the neck preferably has a sealing section, which protrudes somewhat from the neck section 10 in the radial direction and which in the fully assembled state, is circumferentially enclosed by the passage 9 of the adapter ring 8. Ideally, the outer diameter of the sealing section 21 is selected to be somewhat greater, for example 1/10 mm to 3/10 mm greater, than the inner dimeter of the passage 9. In this way, the sealing section 21 is wedged into the passage 9 in a sealed fashion in the assembled state. This has the advantage that any excess cosmetic, which, even with careful handling, sometimes flows out from the neck section 10, cannot penetrate into the gap between the passage 9 and the sealing section 21 and become a nuisance there. Instead, with the embodiment selected here, the neck can be easily wiped completely clean with a facial tissue. In most cases, in the region of its withdrawal opening on its inner circumference surface, the neck 4 also has a detent groove 20 for affixing a wiper, which is not shown here. Even though the wiper is not graphically depicted here, it should nevertheless be noted that in the vast majority of cases, it is part of the cosmetic receptacle system according to the invention.

By and large, it can be stated that for this exemplary embodiment, it is essential to the invention that the receptacle 2—except for its neck—is completely accommodated on the interior, which is jointly enclosed by the concealing sleeve 5 and the adapter ring 8, while the neck protrudes freely outward in order to be available there for the direct connection with a cap or closure of any kind, which a user can freely open and reclose again.

Second Exemplary Embodiment

Figure 8:
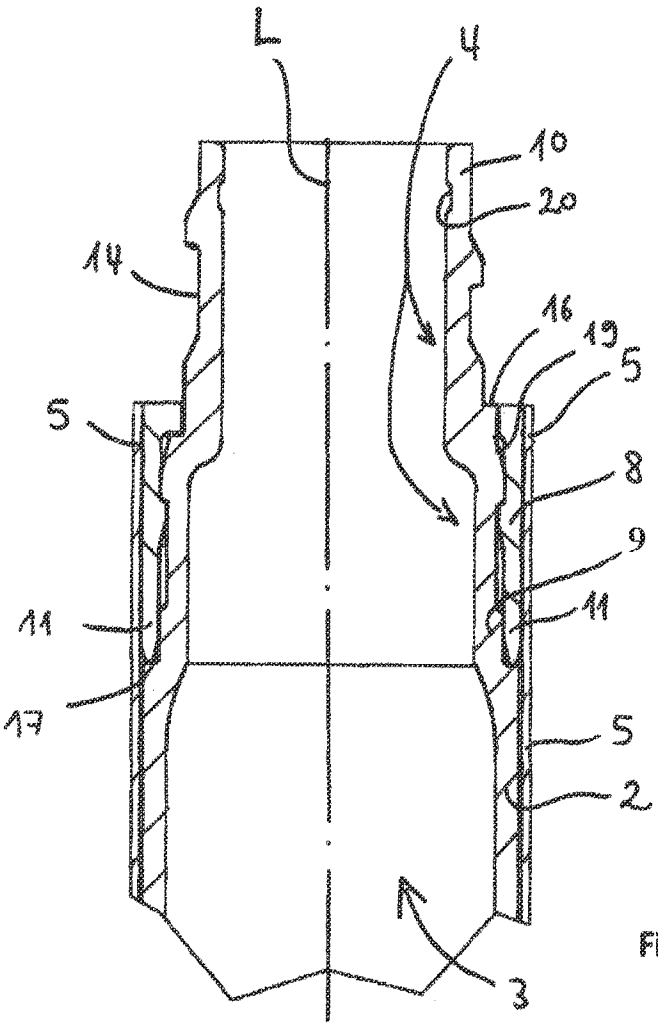
Figure 7:
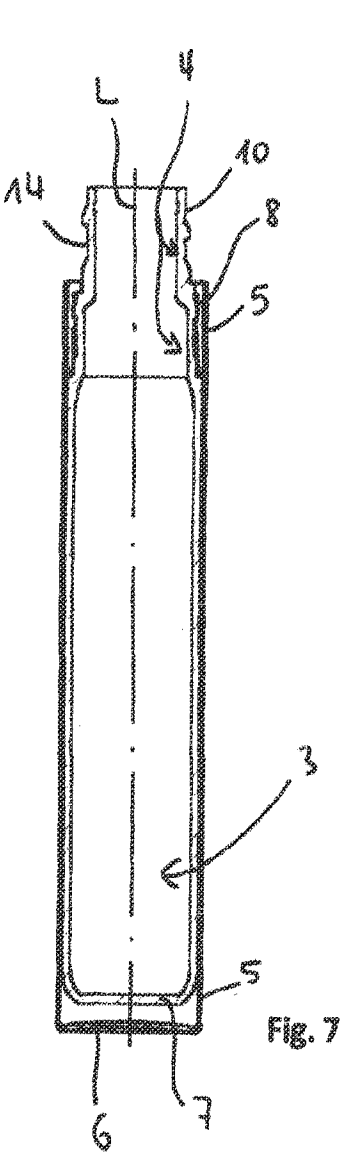
Figure 6:
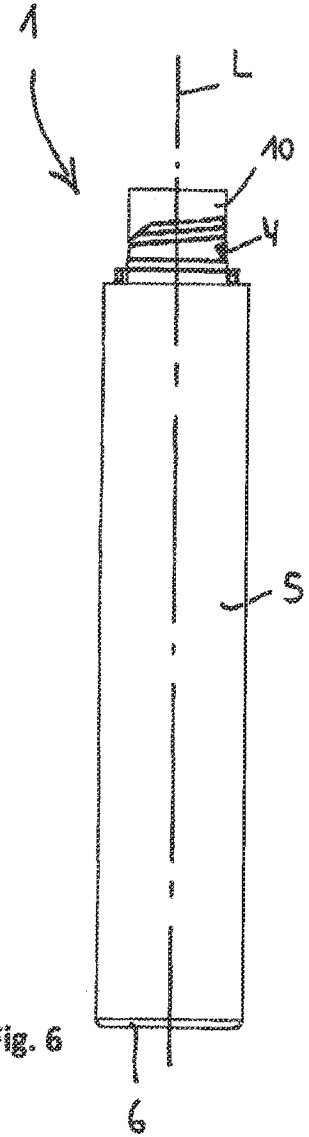

FIGS. 6 through 8 show a second exemplary embodiment of the invention. The above statements apply equally here unless otherwise indicated by the differences described below.

In this exemplary embodiment, the concealing sleeve 5 is embodied as longer, preferably so that it overlaps between 25% and 60% of the circumference surface of the neck 4. In the region in which the concealing sleeve 5 overlaps the neck, it is tapered relative to the storage section 3, i.e. in this region, the outer diameter of the neck 4 is already smaller than the outer diameter of the storage section 3. As a result of this, in the course of the insertion of the receptacle 2 into the concealing sleeve 5, an annular open space is formed between the concealing sleeve 5 and the neck 4. In this exemplary embodiment, the adapter ring 8 is slid into this annular space, preferably so that viewed in the direction of the longitudinal axis L, it is completely situated (fully or substantially) between the outer surface of the neck 4 and the inner surface of the concealing sleeve 5.

As has already been described in connection with the first exemplary embodiment, in the region between its passage 9 and its opposite end, the adapter ring 8 is fastened to the neck 4. Here, too, the adapter ring 8 is preferably affixed to the neck 4 in a form-fitting fashion. To this end, the neck 4 can also have a detent groove 14, which is engaged by detent elements 15 that protrude inward from the inner circumference surface of the adapter ring 8 or by an inward-protruding detent bead. To achieve this, the adapter ring 8 simultaneously has a means, e.g. an annular section, with which it embraces an end ring section 16, which is formed by a stepped tapering of the neck, see FIG. 8, left side.

By and large, it can be stated for this exemplary embodiment as well that it is also essential to the invention that the receptacle 2—except for its neck—is completely accommodated in the interior, which is jointly enclosed by the concealing sleeve 5 and also partially by the adapter ring 8, while the neck protrudes freely outward in order to be available there for the direct connection with a cap or closure of any kind, which a user can freely open and reclose again.

Third Exemplary Embodiment

Figure 9:
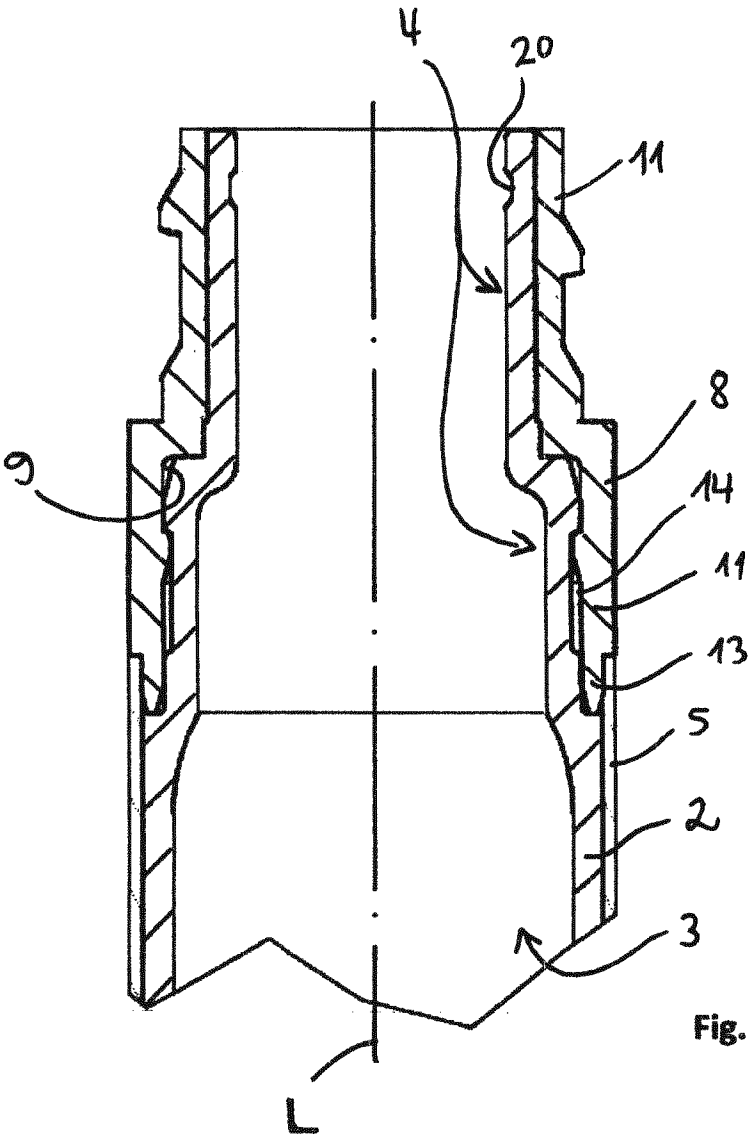
Figure 11:
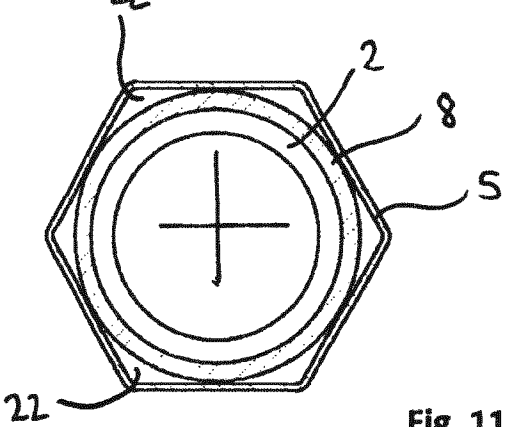
Figure 12:
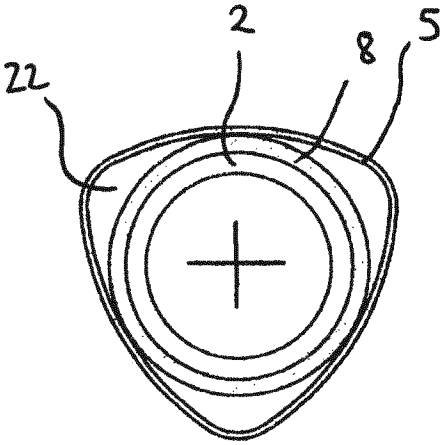
Figure 10:
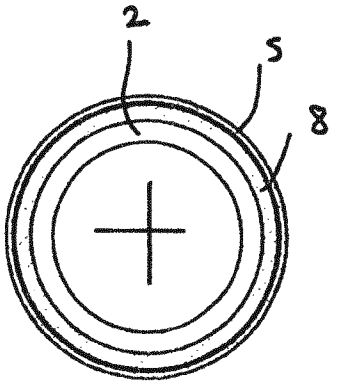
Figure 15:
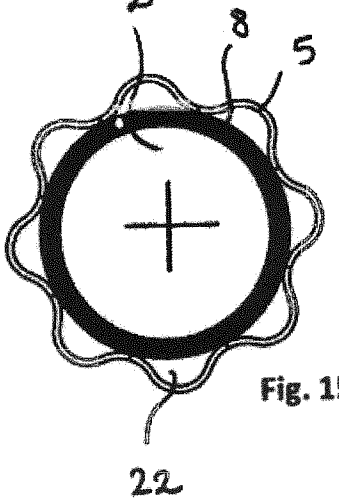
Figure 14:
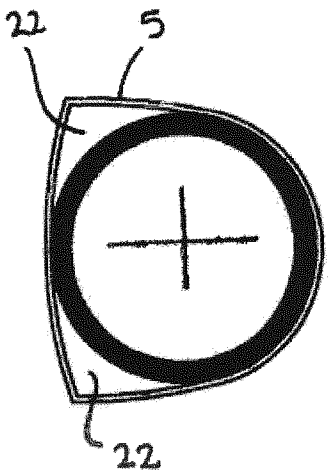
Figure 13:
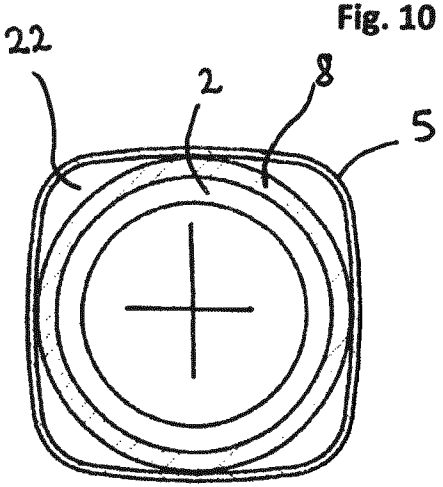

FIGS. 9 through 11 show a third exemplary embodiment of the invention. The above statements apply equally here unless otherwise indicated by the differences described below.

With regard to this exemplary embodiment, it should be noted that the receptacle 2 here features the fact that it has a uniformly smooth neck section 10 on the outer circumference surface. In other words, the neck section 10 has no threads and no detent elements.

Apart from this fact, this exemplary embodiment differs from the first exemplary embodiment in that the adapter ring 8 is embodied to be longer in the direction of the neck section 10. The adapter ring 8 overlaps the neck section 10 and thus the entire neck completely, ideally so that the neck section 10 and the adapter ring 8 end in the same horizontal plane at the height of the withdrawal opening. In the region that overlaps the neck section 10, the adapter ring 8 here has a threaded section or (not graphically depicted) at least one detent section for attaching a cover in the form of a cap that embraces the outer circumference of the adapter ring 8, as already explained above.

It should especially be noted that the attachment of the adapter ring 8 to the receptacle 2 is carried out as described above for the first exemplary embodiment. The centering between the adapter section 11 and the concealing sleeve 5 is also carried out as described above for the first exemplary embodiment.

Fourth Exemplary Embodiment

A fourth exemplary embodiment of the invention is not graphically depicted. This fourth exemplary embodiment features the fact that the adapter ring 8 is slid into the interstice between the neck 4 and the concealing sleeve 5, as has been described above for the second exemplary embodiment. Apart from this, the adapter ring 8 is embodied as has been described above for the third exemplary embodiment. Unless otherwise required by the specifics described above, the statements made above for the first exemplary embodiment also apply to this fourth exemplary embodiment.

Fifth Exemplary Embodiment

Figure 19:
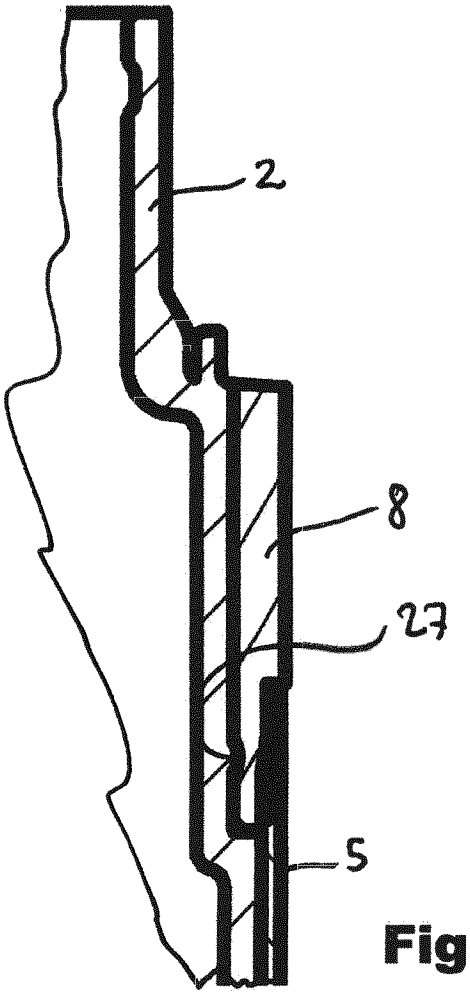
Figure 18:
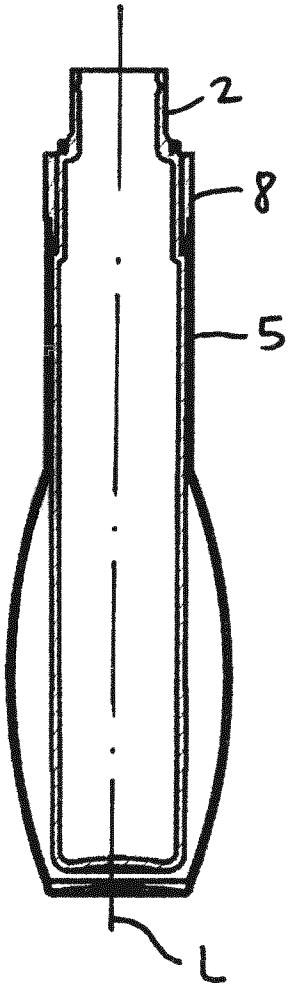
Figure 17:
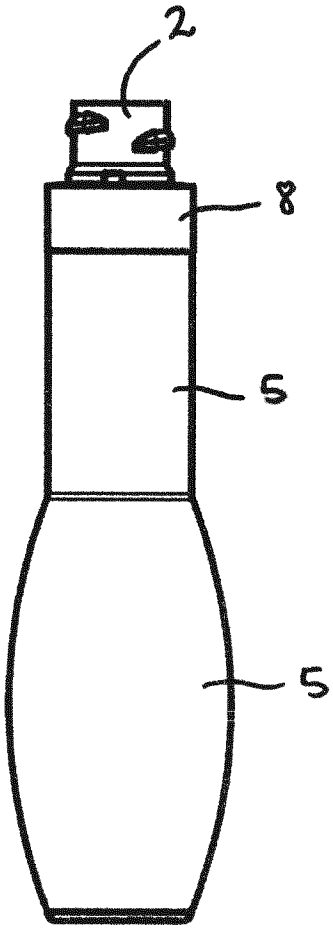

FIGS. 17 through 19 show a fifth exemplary embodiment of the invention. For this embodiment, the statements made above are equally applicable unless otherwise indicated by the differences described below.

In this case, the concealing sleeve 5 is used to produce a cosmetic receptacle, which is haptically very attractive and round-bellied but which, due to its receptacle 2 that extends like a straight cylinder on the inside, has no "dead volume" that must be unnecessarily filled with cosmetic compound that cannot subsequently be correctly withdrawn by the applicator that has been inserted into the receptacle.

The connection of the receptacle 2 to the concealing sleeve 5 and the adapter ring 8 is similar to that which has been described in conjunction with FIG. 3.

There is an optional difference, though. The detent groove 27 or detent element on the inner circumference surface of the adapter ring 8 is embodied in a region of the adapter ring 8, which has a reduced wall thickness and onto the outside of which the concealing sleeve 5 is slid.

This region of the adapter ring 8 can expand quite easily at first and as a result, can undergo a detent engagement with the receptacle 2, which engagement is composed of two detent elements that embrace each other in a manner that is form-fitting to a particularly large degree. By means of the subsequent sliding-on of the concealing sleeve 5, the supporting action of the concealing sleeve 5 prevents the adapter ring 8 from tending to expand in the region of the detent connection. This produces a particularly good detent connection.

Sixth Exemplary Embodiment

Figure 23:
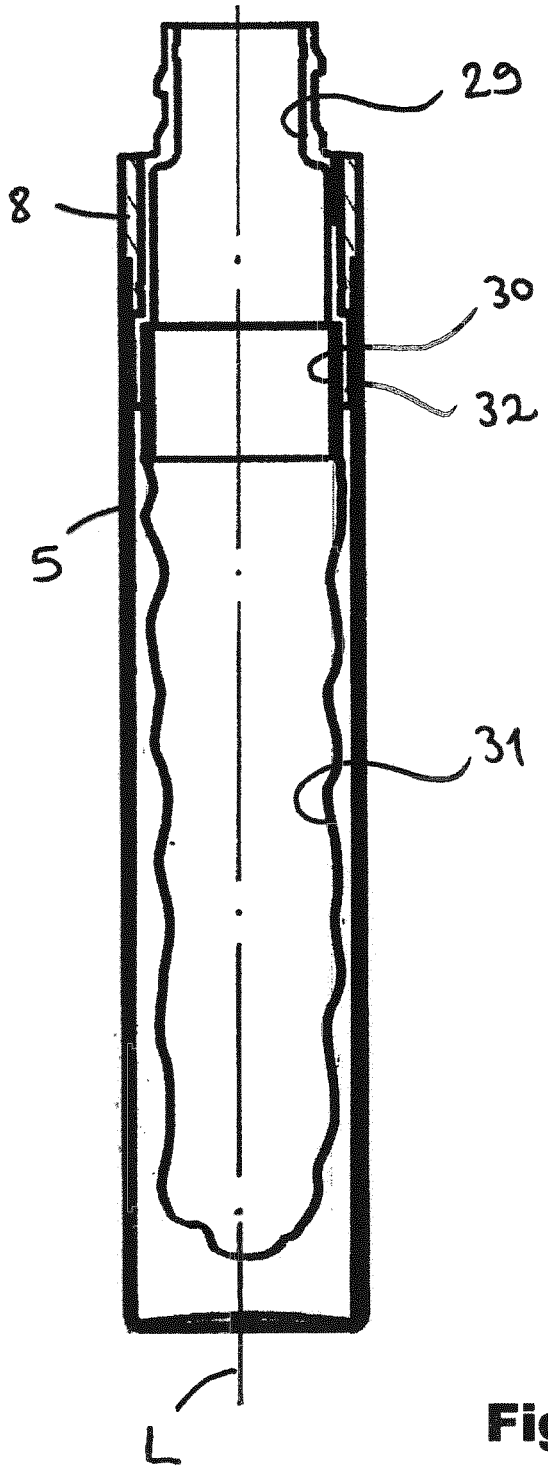

FIG. 23 shows a sixth exemplary embodiment of the invention. For this embodiment, the statements made above are equally applicable unless otherwise indicated by the differences described below due to the use of a receptacle 2, which, in terms of its volume, is overwhelmingly composed of film.

With such a receptacle made of film, which gives a cheap appearance, the use of the concealing sleeve according to the invention is particularly advantageous.

The following embodiment is particularly preferable:

A self-supporting, i.e. essentially deflection-resistant, neck section **29*a* is used, which provides the bottle neck that protrudes outward from the concealing sleeve, usually together with the thread embodied thereon for screwing on the cap, which is not shown in FIG. 23**.

The neck section **29*a* is connected to the rest of the receptacle 2, which in this case consists of a bushing 30 that is self-supporting in the above-described way and that is adjoined by a sack-like structure 31 made of flexible film—as a rule by being welded or glued to the bushing 30. In this exemplary embodiment, the bushing 30 is inserted into the bushing opening 32 and preferably detent-locked or otherwise welded or glued. In some variants, the actually advantageous bushing composed of a separate component can be eliminated. Then the sack-like structure 31 is fastened to an integral tubular section of the neck section 29*a***.

The sack-like structure is preferably made of a film with a wall thickness of between 0.5/10 and 3/10 mm.

As is readily apparent from FIG. 23, the receptacle 2 is jointly formed by the sack-like structure 31 with the optional bushing 30 and the neck section **29*a*. As is readily apparent, in this case, the sack-like structure 31** makes up the majority of the receptacle in terms of its volume.

In light of the foregoing, the sack-like structure 31 is flexible, i.e. is not by itself able to appreciably or substantially resist forces that seek to squeeze it in the radially inward direction from its completely inflated state.

General Notes Regarding all of the Exemplary Embodiments

FIGS. 12 through 15 show an example of the overall system, in which—with the aid of several receptacles 2 that are always the same and different adapter sleeves 5 as well as the associated different adapter rings 8—different cosmetic receptacle units have been produced at a low cost. As is apparent, it is in no way necessary for the receptacle 2 to rest with its outer circumference surface entirely against the inner circumference surface of the concealing sleeve 5. Quite to the contrary, as is apparent, the system according to the invention includes at least one, preferably several, concealing sleeves 5, at most 25% of the inner circumference surface of which is in direct contact with the outer circumference surface of the receptacle 2. Where there is no contact between the receptacle 2 and the concealing sleeve 5, there are cavities 22, as is readily apparent from FIGS. 10 through 15. These cavities 22, however, are not intrusive and are generally also not visible since they are closed off from the external surroundings by the correspondingly embodied adapter rings 8, usually also at the upper end or end ring surface that is oriented toward the freely extending neck section.

As is also readily apparent from FIGS. 12 through 15, the system preferably always consists of the same receptacles 2 or in any case, a small number thereof. By combining an identical receptacle or a few identical receptacles 2 with different concealing sleeves 5 that are part of the system and with the different adapter rings 8 that are associated with them, it is possible to produce a series of cosmetic receptacle units with entirely different appearances for a low tool cost.

It should also be noted that an optional, but very attractive aspect has not yet been expressed in the graphic depictions up to this point.

Ideally, the system according to the invention includes at least one and preferably several concealing sleeves 5, which do not provide any guidance for the receptacle 2. The positioning of the receptacle 2 relative to the concealing sleeve 5 that relates to this instance is ensured entirely by the adapter ring 8. In other words, it is solely or at least predominantly the adapter ring 8 that determines and maintains the positioning of the receptacle 2 relative to the concealing sleeve 5. This permits a considerable degree of freedom for the combination possibilities of the system. As a result, the concealing sleeves can be very freely designed without even having to pay the least consideration to the receptacle 2.

It should also be noted that, as is readily apparent from FIGS. 12 through 15, receptacles that are particularly unusual from a design standpoint have a lot of so-called "dead volume," for example corners and angles, which can contain the cosmetic compound, but from which it is hardly possible to withdraw the cosmetic compound subsequently because the applicator, which is fastened to the cap by means of a wand, can only be navigated into the region of the dead volume with great difficulty so as to withdraw the cosmetic compound remaining there. In this regard as well, the receptacle 2 that is provided inside the unusually designed concealing sleeve constitutes a decisive improvement.

FIGS. 16 and 16*a* show a particularly advantageous possibility for fastening a concealing sleeve 5 made of metal. In the end region of its mouth oriented toward the adapter ring 8, the concealing sleeve 5 has a reduced wall thickness. At the extreme end, the concealing sleeve 5 is folded inward, i.e. provided with an inner cuff 24. Ideally, the adapter ring is provided with a detent element 25 in the form of a circumferential, annular detent bead or several local detent protrusions. The cuff 24 engages behind this or these in a form-fitting fashion as soon as the concealing sleeve 5 has reached its end position on the adapter ring.

Another optionally provided detail is shown in FIG. 16*a*. On its end surface oriented toward the bottom end, the adapter ring is provided with a welding projection 26. The welding projection 26 preferably tapers toward its end surface; in this case, it can be a ring extending in the circumference direction or a plurality of local projections. The ring or the projections is/are dimensioned so that when acted on with oscillations, preferably ultrasonic oscillations, and pressure, it/they is/are welded to the opposite end of the annular shoulder step of the receptacle 2.

Such a fastening by means of the above-mentioned welding can be beneficially employed not only with the use of a metal concealing sleeve 5, but also with the other variants of the concealing sleeves disclosed here. For example, reference is made to FIG. 16*b* in this regard.

Figure 20:
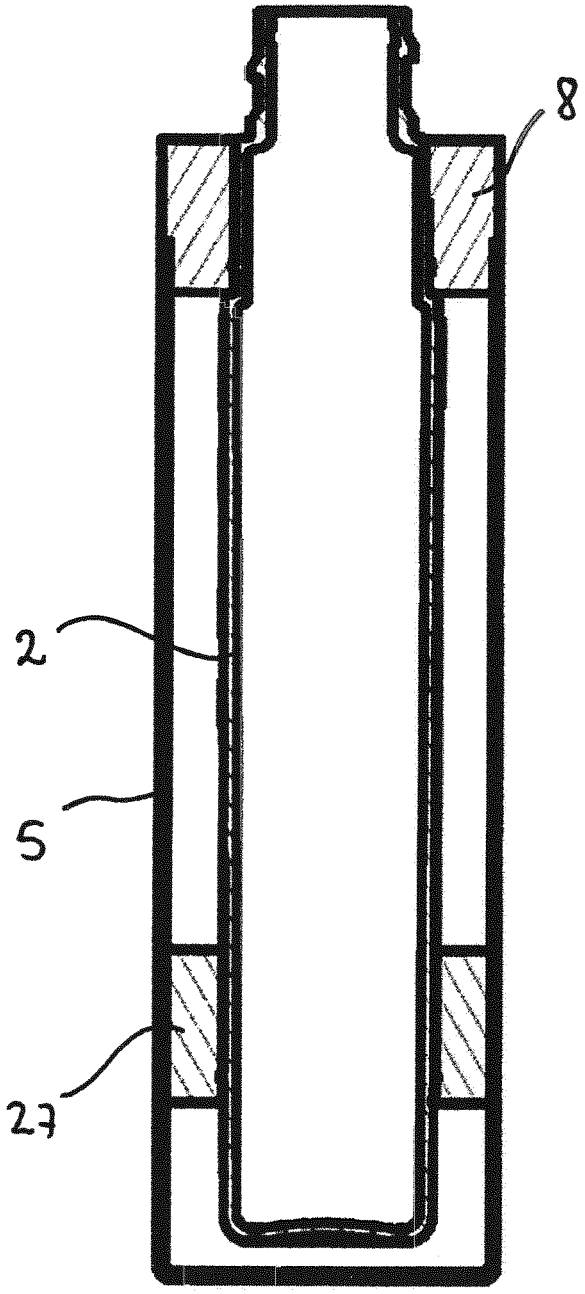

In a way that is likewise applicable to all of the variants described previously, FIG. 20 shows how a receptacle 2 can be securely accommodated in a concealing sleeve 5, which has an outer diameter that is smaller by such an amount that it does not rest against the inner surface of the concealing sleeve 5 at any point. Such a lower caliber receptacle is secured in the predefined position inside the concealing sleeve with the aid of the adapter sleeve 8 and at least one centering ring 27 that is spatially separate therefrom and is inserted into the interstice between the concealing sleeve 5 and the receptacle 2, preferably so that the sleeve does not rest directly against the concealing sleeve 5 at any point.

Figure 21:
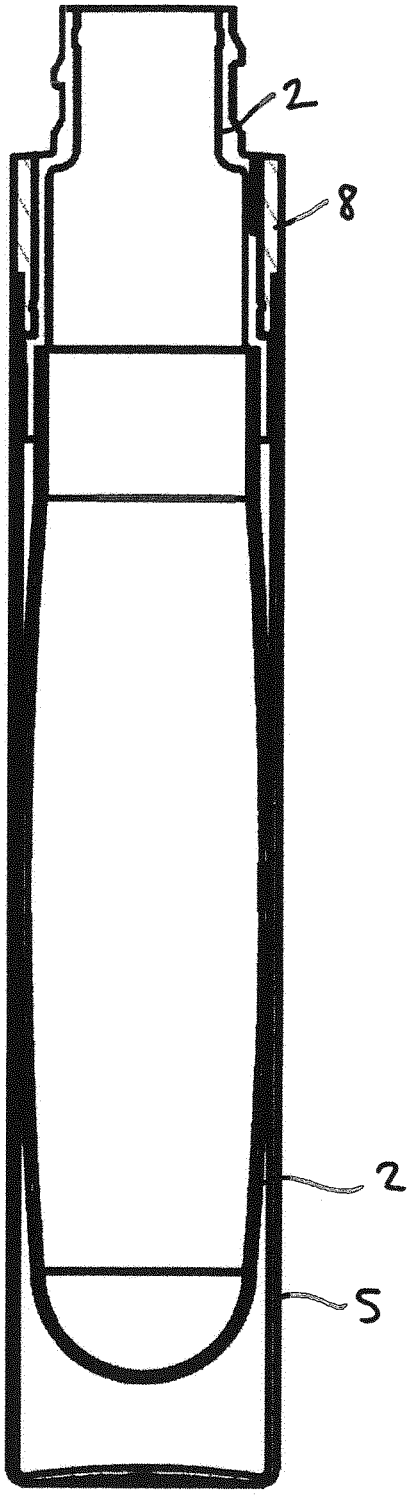

In a way that is likewise applicable to all of the variants described previously, FIG. 21 shows an alternative approach for how a receptacle 2 can be securely accommodated in a concealing sleeve 5.

In this case, a receptacle is used, whose casing is embodied and dimensioned relative to the concealing sleeve so that during the insertion into the concealing sleeve, it elastically deforms and therefore rests with an elastic prestressing force against a large area—or at least at several points—of the inner circumference surface of the concealing sleeve. In connection with this embodiment, it is particularly advantageous and thus preferable if the circumference surface of the receptacle 2 is embodied as arched—in the sense that the radius of the actual body of the receptacle below its neck is larger in the middle region than at the ends oriented toward the neck and the bottom.

Figure 22:
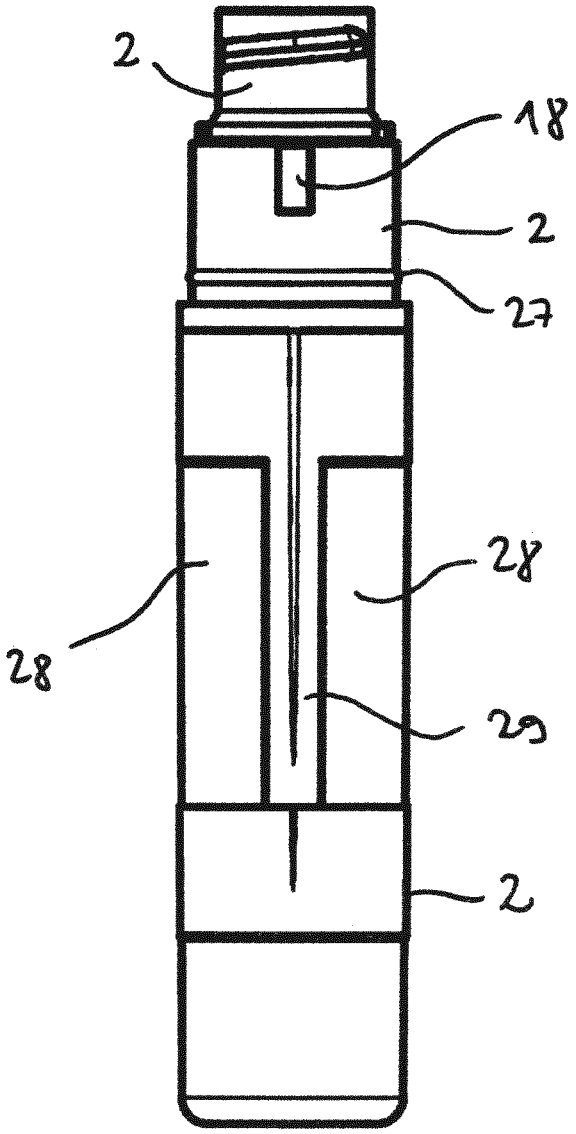

An alternative type of attachment is shown in FIG. 22. In this case, the circumference surface of the receptacle 2 is provided with pockets 28 for accommodating adhesive. In this case, a pocket 28 is formed by a region of the receptacle casing that has a reduced diameter relative to the immediately surrounding regions of the receptacle casing.

The pockets 28 ensure that adhesive can be applied to the receptacle 2 so that it is not completely wiped off when the receptacle 2 is inserted into the concealing sleeve 5, but instead, is conveyed into the interior of the concealing sleeve 5 to a sufficient degree in order to ensure a gluing of the receptacle 2 to the concealing sleeve 5.

In this case, a pocket 28 is preferably embodied so that it does not extend all the way around the receptacle in the circumference direction. In order to be able to ensure this, one or more longitudinal struts can be provided, for example, as identified with the reference numeral 29 in FIG. 22. An interesting option is to provide each of the struts 29 with a venting groove that maybe slim as shown by FIG. 22 in the middle of the strut 29. The venting grove avoids the disturbing generation of a "pressure cushion" by means of the pumping effect that occurs when the receptacle 2 is stuck into a concealing sleeve with a closed bottom while the receptacle 2 has essentially the same outer diameter as the inner diameter of the concealing sleeve. In regard to the venting groove reference is made to FIG. 23, where the venting grove is marked with the reference number 33.

Figure 24:
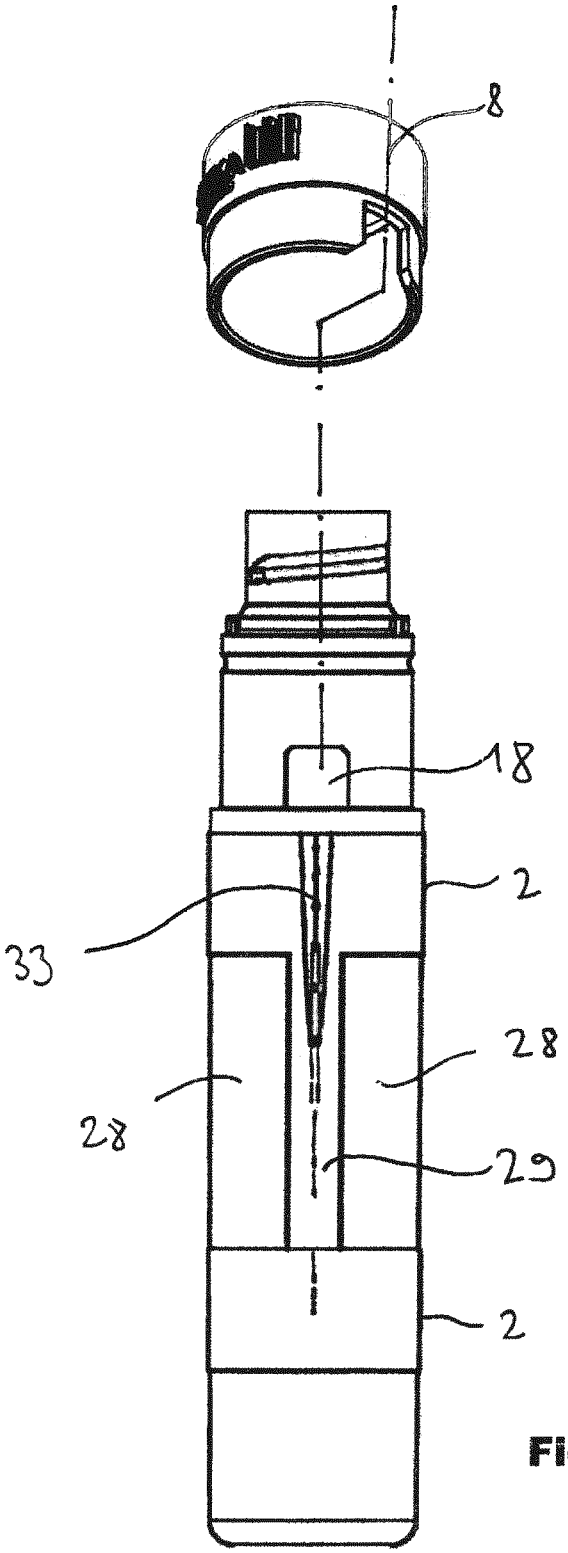

The cosmetic receptacle according to FIG. 22 illustrates the rotation limiter 18—preferably embodied in the form of a projection that engages in a form-fitting fashion —, which is embodied so that it ensures that the receptacle 2 can only be installed in a particular position relative to the adapter ring 8 and also permanently retains this position during use. As long as the rotation limiter is positioned as shown by FIG. 22 is may be visible even in fully mounted state, compare FIG. 4*a*. In case this is disturbing it is recommended to provide the rotation limiter not in the position shown by FIG. 22 but in the position shown by FIG. 24. That way the rotation limiter can engage with a window in the adapter ring 8 that is—if all is fully mounted—positioned inside the concealing sleeve 5 overlapping the adapter ring. So the rotation limiter is fully concealed.

Miscellaneous

Protection also sought for, too, for the following more detailed developments which are disclosed paragraph by paragraph. Said protection is claimed without other features of the claims or of the specification as well as together with other features of existing claims or of the specification.

A cosmetic receptacle system being designed in that the adapter ring has a rotation limiter (18)—preferably embodied in the form of a projection that engages in the receptacle (2) in a form-fitting fashion —, which is embodied so that it ensures that the receptacle (2) can only be installed in a particular position relative to the adapter ring (8) and also permanently retains this position during use.

A cosmetic receptacle system according to the two preceding paragraphs, designed so that the concealing sleeve (5) consists of a ductile material, preferably metal, and in the end region of its mouth (5) that is oriented toward the adapter ring (8), has a decreasing wall thickness, with the concealing sleeve (5) at the end of the end region preferably being provided with an inner cuff (24) and ideally, a detent element (25) is also provided on the adapter ring, behind which this cuff (24) engages in a form-fitting fashion.

A cosmetic receptacle system according to the three preceding paragraphs, designed in that on its end surface oriented toward the bottom end, the adapter ring (8) is provided with a welding projection (26), which preferably narrows toward its end surface.

A cosmetic receptacle system according to one of the four preceding paragraphs, designed in that a receptacle that has a lower caliber than the concealing sleeve is secured in the predefined position inside the concealing sleeve with the aid of the adapter ring (8) and at least one centering ring (27) that is spatially separate therefrom and is inserted into the interstice between the concealing sleeve (5) and the receptacle (2).

A cosmetic receptacle system according to one of the five preceding paragraphs, designed in that the circumference surface of the receptacle (2) is provided with pockets (28) for accommodating adhesive, with each pocket (28) being preferably formed by a region of the receptacle casing, which has a reduced diameter relative to the immediately surrounding regions of the receptacle casing.

A cosmetic receptacle system according to one of the six preceding paragraphs, designed in that a receptacle is used, whose casing is embodied and dimensioned relative to the concealing sleeve so that during the insertion into the concealing sleeve, it elastically deforms and therefore rests with an elastic pre-stressing force against the inner circumference surface of the concealing sleeve.

A cosmetic receptacle system according to one of the seven preceding paragraphs designed in that the receptacle (2) consists of a neck section (29*a*), which is connected to the rest of the receptacle (2), which consists of an—optionally provided—self-supporting bushing (30) that is adjoined in a fluid-tight fashion by a sack-like structure 31 made of flexible film.

A cosmetic receptacle system according to one of the eight preceding paragraphs, designed in that the bushing (30) is inserted into a bushing opening (32) of the neck section (29*a*) and is preferably detent-locked or otherwise welded or glued.

A cosmetic receptacle system according to one of the nine preceding paragraphs, designed in that the sack-like structure (31) is fastened to an integral tubular section of the neck section (29*a*).

A cosmetic receptacle system according to one of the ten preceding paragraphs designed in that the sack-like structure is made of a plastic film with a wall thickness of between 0.5/10 and 3/10 mm.

A cosmetic receptacle system according to one of the eleven preceding paragraphs designed in that the interspace between the receptacle and the concealing sleeve is filled out by a glue or a foam.

Figure 16B:
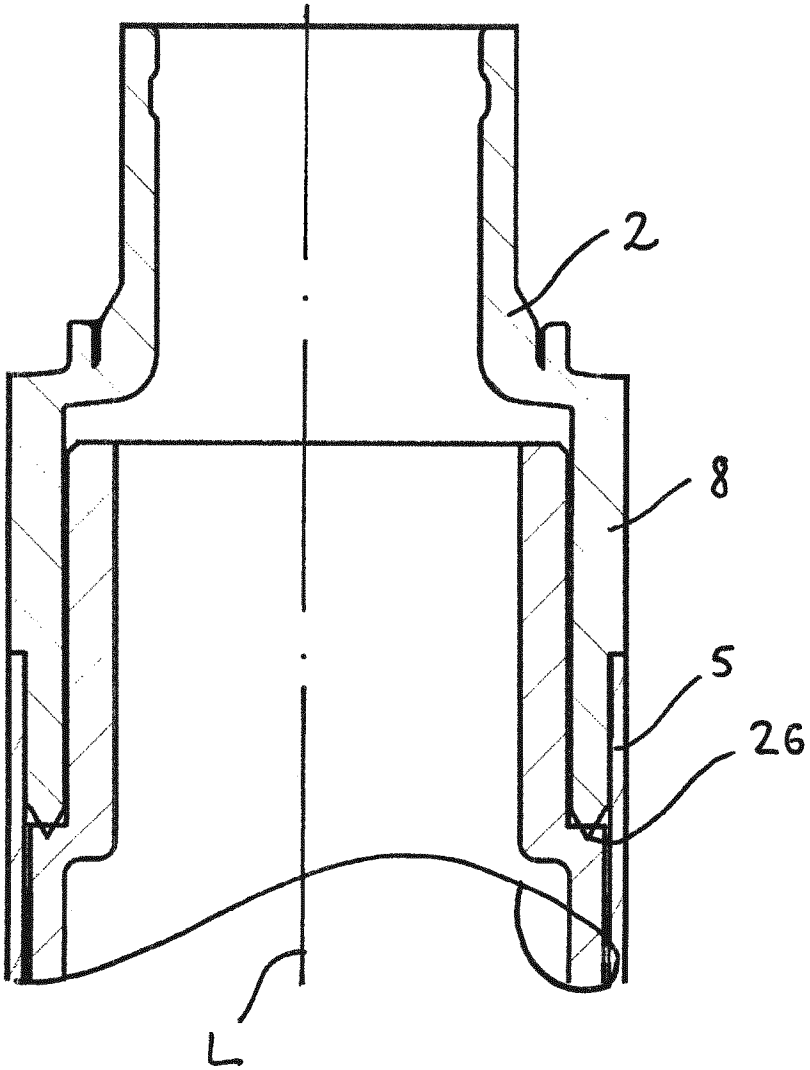

A cosmetic receptacle system according to one of the twelve preceding paragraphs designed in that the adapter ring 8 carries at is face side—directed toward the bottom—a welding projection (26) that preferably becomes slimmer in direction to its free face side (see, for example, FIG. 16*b*).

A cosmetic receptacle unit consisting of a receptacle (2), a concealing sleeve (5), and an adapter ring (8) according to one of the preceding thirteen preceding paragraphs.

REFERENCE NUMERAL LIST

1 cosmetic receptacle unit
2 receptacle
3 storage section
4 neck
4*a* cap
4*b* not assigned
4*c* wand (that supports an applicator)
5 concealing sleeve
6 bottom of the concealing sleeve
7 bottom of the receptacle
8 adapter ring
9 passage of the adapter ring
10 freely extending neck section
11 adapter section
12 supporting section
13 annular projection
14 detent groove of the neck
15 detent element of the neck
16 end ring section
17 end ring section
18 rotation limiter
18*a* rotation stop on the bottle neck
19 assembly bevel
20 detent groove
21 sealing section
22 cavities
23 end region of the adapter sleeve
24 cuff of the adapter sleeve
25 detent element
26 welding projection

27 centering ring
28 pocket for accommodating adhesive
29 longitudinal strut
29*a* neck section
30 bushing
31 sack-like structure
32 bushing opening
L longitudinal axis

The invention claimed is:

1. A cosmetic receptacle system comprising:

a receptacle, which is self-supporting or consists of flexible film over a majority of a volume of the receptacle and one end of the receptacle constitutes a withdrawal opening in a form of a tapered neck;

a cap;

a single concealing sleeve selected from a plurality of concealing sleeves with different outer cross-sectional shapes; and a single adapter ring selected from a plurality of adapter rings, each adapter ring having a socket for the neck of the receptacle, enclosing the neck of the receptacle in a circumference direction, and constituting at least one stop, which prevents the receptacle from being pulled outward through the adapter ring, and each adapter ring, at an end oriented toward a bottom of the receptacle, having an adapter section with an outer cross-section that essentially corresponds to an outer cross-section that a concealing sleeve that corresponds to this adapter ring has at a free end oriented toward the neck of the receptacle, said adapter ring being insertable between the concealing sleeve and the receptacle and being form-fitted affixed to the neck, wherein the adapter section of an adapter ring is stepped at its edge, which rims the free end of the adapter section that is oriented toward the neck of the receptacle, and forms an annular projection that engages internally behind a wall of a corresponding concealing sleeve and in so doing, centers a correspondingly embodied outer circumference surface of the adapter ring and a correspondingly embodied outer circumference surface of the concealing sleeve relative to each other so that the outer circumference surface of the adapter ring and the outer circumference surface of the concealing sleeve transition smoothly into each other.

2. The cosmetic receptacle system according to claim 1, wherein the plurality of concealing sleeves consist of metal.

3. The cosmetic receptacle system according to claim 1, wherein at least one of the concealing sleeves belonging to the system has a closed bottom.

4. The cosmetic receptacle system according to claim 3, wherein the bottom of the receptacle and the bottom of the at least one concealing sleeve are spaced apart from each other.

5. A cosmetic receptacle system comprising:

a receptacle, which is self-supporting or consists of flexible film over a majority of a volume of the receptacle and one end of the receptacle constitutes a withdrawal opening in a form of a tapered neck;

a cap;

a single concealing sleeve selected from a plurality of concealing sleeves with different outer cross-sectional shapes; and a single adapter ring selected from a plurality of adapter rings, each adapter ring having a socket for the neck of the receptacle, enclosing the neck of the receptacle in a circumference direction, and constituting at least one stop, which prevents the receptacle from being pulled outward through the adapter ring, and each adapter ring, at an end oriented toward a bottom of the receptacle, having an adapter section with an outer cross-section that essentially corresponds to an outer cross-section that a concealing sleeve that corresponds to this adapter ring has at a free end oriented toward the neck of the receptacle, said adapter ring being insertable between the concealing sleeve and the receptacle and being form-fitted affixed to the neck, wherein at least one of the concealing sleeves belonging to the system does not have a closed bottom, but rather a passage having an inner opening that is adapted to the receptacle and which is closed by the receptacle or by the bottom of the receptacle.

6. The cosmetic receptacle system according to claim 1, wherein in a place where the annular projection engages behind the concealing sleeve, the annular projection is supported from inside by a supporting section of the neck in such a way that the annular projection is clamped in a frictional, nonpositive way between an inner surface of the concealing sleeve and a supporting section of the neck.

7. The cosmetic receptacle system according to claim 1, wherein predominantly or at least in a place where the adapter ring forms the adapter section, a wall thickness of the adapter ring is greater than a wall thickness of the concealing sleeve.

8. The cosmetic receptacle system according to claim 1, wherein at least one of the plurality of concealing sleeves is embodied so that when the receptacle is inserted all the way into the at least one concealing sleeve between the at least one concealing sleeve and the neck of the receptacle, an annular open space is produced between the at least one concealing sleeve and the neck of the receptacle, which accommodates the entire adapter ring.

9. The cosmetic receptacle system according to claim 1, wherein the adapter rings can be detent-locked to the neck of the receptacle or receptacles belonging to the system.

10. The cosmetic receptacle system according to claim 1, wherein the neck of the receptacle and a passage of a respective one of the plurality of adapter rings are matched to each other so that the neck of the receptacle protrudes outward through the passage of the respective adapter ring and forms a freely extending neck section there from which a cap can be removed and re-affixed to the freely extending neck section in a reclosable fashion.

11. A cosmetic receptacle system comprising:

a receptacle, which is self-supporting or consists of flexible film over a majority of a volume of the receptacle and one end of the receptacle constitutes a withdrawal opening in a form of a tapered neck;

a cap;

a single concealing sleeve selected from a plurality of concealing sleeves with different outer cross-sectional shapes; and a single adapter ring selected from a plurality of adapter rings, each adapter ring having a socket for the neck of the receptacle, enclosing the neck of the receptacle in a circumference direction, and constituting at least one stop, which prevents the receptacle from being pulled outward through the adapter ring, and each adapter ring, at an end oriented toward a bottom of the receptacle, having an adapter section with an outer cross-section that essentially corresponds to an outer cross-section that a concealing sleeve that corresponds to this adapter ring has at a free end oriented toward the neck of the receptacle, said adapter ring being insertable between the concealing sleeve and the receptacle and being form-fitted affixed to the neck, wherein the neck of the receptacle and a passage of a respective one of the plurality of adapter rings are matched to each other so that the neck of the receptacle protrudes outward through the passage of the respective adapter ring and forms a freely extending neck section there from which a cap can be removed and re-affixed to the freely extending neck section in a reclosable fashion, and wherein relative to the neck section, which is embraced by the passage, the freely extending neck section is tapered in such a way that the freely extending neck section—despite a detent bead, an arrangement of detent protrusions, or a thread flank that protrudes outward from the freely extending neck section—can be slid through the passage.

12. A cosmetic receptacle system comprising:

a receptacle, which is self-supporting or consists of flexible film over a majority of a volume of the receptacle and one end of the receptacle constitutes a withdrawal opening in a form of a tapered neck;

a cap;

a single concealing sleeve selected from a plurality of concealing sleeves with different outer cross-sectional shapes; and a single adapter ring selected from a plurality of adapter rings, each adapter ring having a socket for the neck of the receptacle, enclosing the neck of the receptacle in a circumference direction, and constituting at least one stop, which prevents the receptacle from being pulled outward through the adapter ring, and each adapter ring, at an end oriented toward a bottom of the receptacle, having an adapter section with an outer cross-section that essentially corresponds to an outer cross-section that a concealing sleeve that corresponds to this adapter ring has at a free end oriented toward the neck of the receptacle, said adapter ring being insertable between the concealing sleeve and the receptacle and being form-fitted affixed to the neck, wherein the neck has a sealing section, which protrudes in a radial direction relative to a neck section and which in a fully assembled state, is encompassed circumferentially by a passage of the adapter ring, an outer diameter of the sealing section being greater than an inner dimeter of the passage so that in an assembled state, the sealing section is wedged into the passage in an elastically sealing fashion.

13. The cosmetic receptacle system according to claim 1, wherein the adapter ring fully embraces a neck section and thus the entire neck of the receptacle, so that the neck section and the adapter ring both end in the same horizontal plane at the height of the withdrawal opening.

14. The cosmetic receptacle system according to claim 13, wherein in the region in which the adapter ring embraces the neck section, the adapter ring has a threaded section or at least one detent engagement section for affixing a cover in the form of a cap.

* * * * *